US009425004B2

(12) United States Patent
Cho

(10) Patent No.: US 9,425,004 B2
(45) Date of Patent: Aug. 23, 2016

(54) REINFORCED PIN WHICH HINGE COUPLES A ROTATABLE SHAFT TO THE TRANSFER LINK IN A CIRCUIT BREAKER

(71) Applicant: LSIS CO., LTD., Anyang-si, Gyeonggi-do (KR)

(72) Inventor: Seong Yeol Cho, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/448,804

(22) Filed: Jul. 31, 2014

(65) Prior Publication Data

US 2015/0107981 A1 Apr. 23, 2015

(30) Foreign Application Priority Data

Oct. 17, 2013 (KR) ..... 10-2013-0124176
Oct. 29, 2013 (KR) ..... 10-2013-0129523

(51) Int. Cl.

*H01H 5/00* (2006.01)
*H01H 21/36* (2006.01)
*H01H 69/00* (2006.01)
*H01H 3/46* (2006.01)
(Continued)

(52) U.S. Cl.

CPC ..... *H01H 21/36* (2013.01); *H01H 3/46* (2013.01); *H01H 69/00* (2013.01); *H01H 71/10* (2013.01); *H01H 1/226* (2013.01); *H01H 71/525* (2013.01); *H01H 2221/016* (2013.01); *H01H 2221/024* (2013.01); *Y10T 29/49105* (2015.01)

(58) Field of Classification Search

CPC ..... H01H 21/36; H01H 69/00; H01H 3/32
USPC ..... 200/558, 400
See application file for complete search history.

(56) References Cited

U.S. PATENT DOCUMENTS 4,729,248 A * 3/1988 Godesa ..... F16N 9/04 184/109
5,735,611 A * 4/1998 Godesa ..... F16C 33/08 384/296

(Continued)

FOREIGN PATENT DOCUMENTS

CN 101165834 A 4/2008
CN 102568949 A 7/2012

(Continued)

OTHER PUBLICATIONS

Korean Intellectual Property Office Application Serial No. 10-2013-0124176, Office Action dated Aug. 20, 2014, 4 pages.

(Continued)

*Primary Examiner* — Vanessa Girardi
(74) *Attorney, Agent, or Firm* — Lee, Hong, Degerman, Kang & Waimey; Jonathan Kang; Richard Salfelder

(57) ABSTRACT

A circuit breaker according to the present disclosure may include a movable contact configured to be brought into contact with or separated from the stationary contact; and a switching mechanism configured to switch the movable contact, wherein the switching mechanism includes a shaft rotatably installed therein; a transfer link configured to transfer a driving force from the shaft to the movable contact; and a pin configured to hinge-couple the shaft to the transfer link and insulate them from each other, and the pin is installed with a wear resistant member at a portion brought into contact with the shaft.

4 Claims, 11 Drawing Sheets

(51) Int. Cl.

| | |
|---|---|
| ***H01H 71/10*** | (2006.01) |
| *H01H 1/22* | (2006.01) |
| *H01H 71/52* | (2006.01) |

(56) References Cited

U.S. PATENT DOCUMENTS

| | | | | |
|---|---|---|---|---|
| 6,777,636 | B2 * | 8/2004 | Ahlert | F16C 33/08 200/244 |
| 7,115,830 | B1 * | 10/2006 | Weister | H01H 3/3031 200/400 |
| 7,323,652 | B2 * | 1/2008 | Yoshida | H01H 33/565 218/154 |

FOREIGN PATENT DOCUMENTS

| | | |
|---|---|---|
| JP | 62-109406 | 7/1987 |
| JP | 08-234561 | 9/1996 |
| JP | 08-235954 | 9/1996 |
| JP | 10-199376 | 7/1998 |
| JP | 2009-075223 | 4/2009 |
| JP | 4549756 | 9/2010 |
| JP | 2011-151023 | 8/2011 |
| KR | 10-1991-0002070 | 1/1991 |
| KR | 10-2004-0079137 | 9/2004 |
| KR | 10-2011-0044622 | 4/2011 |
| KR | 10-2012-0067844 | 6/2012 |

OTHER PUBLICATIONS

Korean Intellectual Property Office Application Serial No. 10-2013-0124176, Notice of Allowance dated Jan. 30, 2015, 2 pages.
Korean Intellectual Property Office Application Serial No. 10-2013-0129523, Notice of Allowance dated Mar. 27, 2015, 2 pages.
Japan Patent Office Application Serial No. 2014-173751, Office Action dated May 1, 2015, 2 pages.
European Patent Office Application Serial No. 14178960.2, Search Report dated Apr. 13, 2015, 7 pages.
State Intellectual Property Office of the People's Republic of China Application Serial No. 201410555581.5, Office Action dated Mar. 4, 2016, 7 pages.

* cited by examiner

REINFORCED PIN WHICH HINGE COUPLES A ROTATABLE SHAFT TO THE TRANSFER LINK IN A CIRCUIT BREAKER

CROSS-REFERENCE TO A RELATED APPLICATION

Pursuant to 35 U.S.C. §119(a), this application claims the benefit of earlier filing date and right of priority to Korean Patent Application Nos. 10-2013-0124176, filed on Oct. 17, 2013, and 10-2013-0129523, filed on Oct. 29, 2013, the contents of which are all hereby incorporated by reference herein in its entirety.

BACKGROUND OF THE INVENTION

1. Field of the Invention

The present invention relates to a circuit breaker and a method of fabricating a pin for a switching mechanism thereof, and more particularly, to a circuit breaker having a pin capable of hinge-coupling and insulating a link of a switching mechanism for switching a moving contact and a method of fabricating a pin for the switching mechanism thereof.

2. Description of the Conventional Art

In general, circuit breaker is a type of electrical device for manually switching an electrical circuit using a handle, or sensing an abnormal current when a short current or fault current occurs to automatically break a circuit, thereby protecting a load device and circuit.

Hereinafter, a circuit breaker in the related art will be described below with reference to FIG. 1.

A circuit breaker in the related art may include a stationary contact 10, a movable contact 20 rotatably provided to be brought into contact with or separated from the stationary contact 10, and a switching mechanism 30 configured to revolve the movable contact 20 to switch a circuit within a case (not shown).

The switching mechanism 30 may include a pin for hinge-coupling a shaft 74 rotatably provided therein, a transfer link 90 configured to transfer a driving force from the shaft 74 to the movable contact 20, and a pin 80 for hinge-coupling the shaft 74 to the transfer link 90.

In this case, referring to FIG. 1, the circuit breaker is formed with a plurality of phases, and a pair of the stationary contact 10 and the movable contact 20 are provided for each phase.

Accordingly, the switching mechanism 30 should be formed with a structure capable of switching a plurality of the movable contacts 20.

Consequently, the movable contact 20 and the transfer link 90 hinge-coupled to the movable contact 20 are provided for each phase.

Furthermore, a shaft arm 74*b* protruded in a radial direction from a shaft rotation axis 74*a* is formed on the shaft 74 for each phase.

The shaft arm 74*b* is hinge-coupled to the transfer link 90 for each phase.

Here, the pin 80 is formed of an insulating material to prevent dielectric breakdown from occurring from a particular phase to another phase.

According to the foregoing configuration, when a handle of the switching mechanism 30 is rotated in a counter clockwise direction on the drawing and closed, the movable contact 20 and the switching mechanism 30 are brought into contact with each other by the switching mechanism 30 to connect a circuit.

On the contrary, when an abnormal current occurs on a line, the trip mechanism (not shown) is operated to release the restriction of a latch 62 of the switching mechanism 30.

When the restriction of the latch 62 is released, the movable contact 20 is rapidly separated from the stationary contact 10 by an elastic force of the tension spring 50 of the switching mechanism 30.

On the other hand, when an abnormal current is removed, the movable contact 20 and the stationary contact 10 are brought into contact with each other again through the manipulation of the switching mechanism 30. I During the process, the pin 80 hinge-couples the shaft 74 to the transfer link 90 to transfer a driving force received from the shaft 74 to the movable contact 20 through the transfer link 90.

Furthermore, the pin 80 insulates the shaft 74 from the transfer link 90 for phase-phase insulation.

However, according to a circuit breaker in the related art, a wear resistance of the pin 80 formed of an insulating material is lower than that of the shaft 74. In other words, a hardness of the pin 80 is lower than that of the shaft 74. Due to this, when switching operations are repeated, a contact portion of the pin 80 to the shaft 74 is worn and damaged. As a result, a contact pressure between the movable contact 20 and the stationary contact 10 may be reduced, thereby increasing a contact resistance thereof.

SUMMARY OF THE INVENTION

Accordingly, an object of the present disclosure is to provide a circuit breaker and a method of fabricating a pin for a switching mechanism thereof capable of hinge-coupling and insulating a link of the switching mechanism to secure an insulating performance and wear resistance thereof, thereby suppressing the abrasion and damage of the pin, and solving a contact pressure reduction and contact resistance increase problem between a movable contact and a stationary contact.

According to the present disclosure, in order to accomplish the foregoing object, there is provided a circuit breaker, including a stationary contact installed in a fixed manner; a movable contact configured to be brought into contact with or separated from the stationary contact; and a switching mechanism configured to switch the movable contact, wherein the switching mechanism includes a shaft rotatably installed therein; a transfer link configured to transfer a driving force from the shaft to the movable contact; and a pin configured to hinge-couple the shaft to the transfer link and insulate them from each other, and the pin is installed with a wear resistant member at a portion brought into contact with the shaft.

The pin may include an insulating member formed in a cylindrical shape, and the wear resistant member may be formed with a pipe, and attached to a portion brought into contact with the shaft of the insulating member.

The wear resistant member may be installed on the insulating member in a fixed manner not to be released therefrom.

The insulating member may be inserted into the wear resistant member, and at least one end portion of the wear resistant member may be deformed to burrow into the insulating member.

The wear resistant member may be formed of a material having a wear resistance greater than that of the insulating member.

The insulating member may be formed of a polyethylene material, and the wear resistant member may be formed of a stainless steel material.

On the other hand, according to the present disclosure, there is provided a method of fabricating a pin for a circuit breaker switching mechanism, the method including forming an insulating member in a cylindrical shape; forming a wear resistant member in a pipe shape capable of surrounding one side of the insulating member; disposing the wear resistant member at one side of the insulating member; and deforming both end portions of the wear resistant member to burrow into the insulating member so as to fix the wear resistant member to one side of the insulating member.

The cross-section of both end portions of the wear resistant member may be formed perpendicular to an inner circumferential surface thereof in the step of forming the wear resistant member.

The wear resistant member may be formed such that a cylindrically shaped material thereof is drilled in a length direction, and the drilled material is cut by a predetermined length, and a burr of the cut material is removed.

Both end portions of the wear resistant member may be pressed and deformed by a press in the step of fixing the wear resistant member to one side of the insulating member.

The press may include an inclined surface formed to be brought into contact with an edge between the cross section of both end portions and an outer circumferential surface of the wear resistant member.

The press may press both end edges of the wear resistant member to the inclined surface by a predetermined dimension in an axial direction of the wear resistant member.

The predetermined dimension may be a value for preventing a bending phenomenon from occurring on the outer circumferential surface of the wear resistant member.

The press may include a die installed in a fixed manner; and a punch installed to face the die so as to move toward the die.

The die may include a first press surface facing the punch; and a first groove formed perpendicular to the first press surface, with which an end of the wear resistant member is engaged, and into which an end of the insulating member protruded from an end of the wear resistant member is inserted, and The punch may include a second press surface facing in parallel to the first press surface; and a second groove formed perpendicular to the second press surface, with which the other end of the wear resistant member is engaged, and into which the other end of the insulating member protruded from the other end of the wear resistant member is inserted.

The first groove may include a first insertion portion formed in an engraved cylindrical shape in a direction perpendicular to the first press surface; and a first chamfer portion inclined to the first press surface and an inner circumferential surface of the first insertion portion, respectively.

The second groove may include a second insertion portion formed in an engraved cylindrical shape in a direction perpendicular to the second press surface; and a second chamfer portion inclined to the second press surface and an inner circumferential surface of the second insertion portion, respectively.

In this case, the first chamfer portion and the second chamfer portion may be the inclined surfaces.

The pin may be formed such that an end of the wear resistant member is engaged with the first chamfer portion, and an end of the insulating member protruded from an end of the wear resistant member is inserted into the first insertion portion.

Furthermore, the pin may be formed such that the other end of the wear resistant member is engaged with the second chamfer portion, and the other end of the insulating member protruded from the other end of the wear resistant member is inserted into the second insertion portion.

At least either one of the die and the punch may include an excessive compression prevention protrusion protruded toward the other one.

The excessive compression prevention protrusion may be brought into contact with the other one when the die and the punch press both end portions of the wear resistant member not to allow the first and the second press surfaces to get closer more than a predetermined distance.

The excessive compression prevention protrusion may include a first excessive compression prevention protrusion protruded toward the second press surface on the first press surface; and a second excessive compression prevention protrusion protruded to face the first excessive compression prevention protrusion on the second press surface.

The first excessive compression prevention protrusion and the second excessive compression prevention protrusion may be brought into contact with each other when the die and the punch press both end portions of the wear resistant member.

The sum of a protrusion length of the first excessive compression prevention protrusion and a protrusion length of the second excessive compression prevention protrusion may be provided to be the same as the predetermined distance.

A pair of the first excessive compression prevention protrusions may be formed to be located at opposite sides to each other by interposing the first groove therebetween.

A pair of the second excessive compression prevention protrusions may be formed to be located at opposite sides to each other by interposing the second groove therebetween to correspond to the pair of the first excessive compression prevention protrusions.

The predetermined distance may be a value for preventing a bending phenomenon from occurring on the outer circumferential surface of the wear resistant member.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a circuit breaker and a method of fabricating a pin for switching mechanism thereof (hereinafter, referred to as an "insulating pin") will be described in detail based on an embodiment illustrated in the accompanying drawings.

Figure 1:
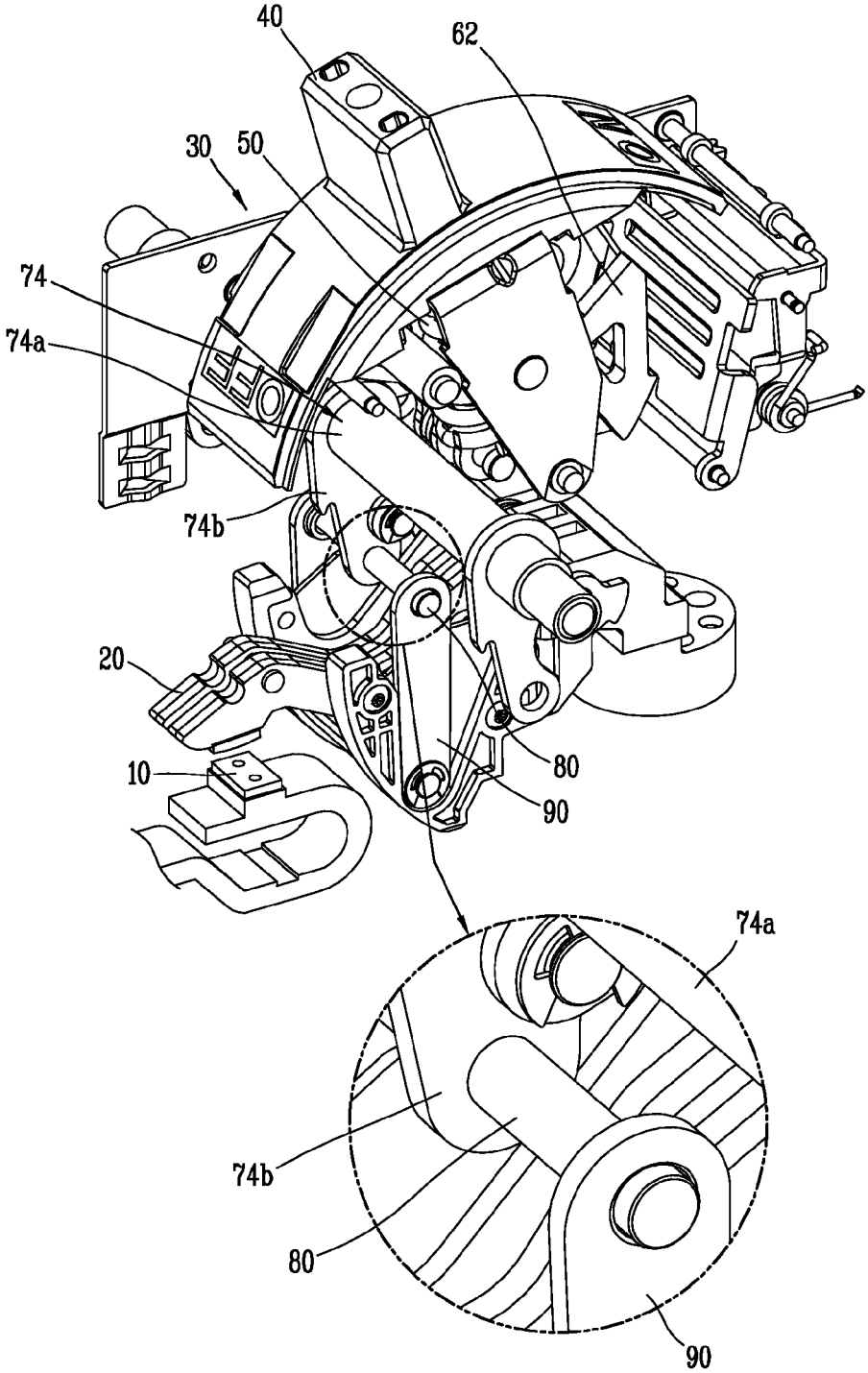
FIG. 1 RELATED ART
FIG. 1 is a perspective view illustrating the inside of a circuit breaker in the related art.
Figure 2:
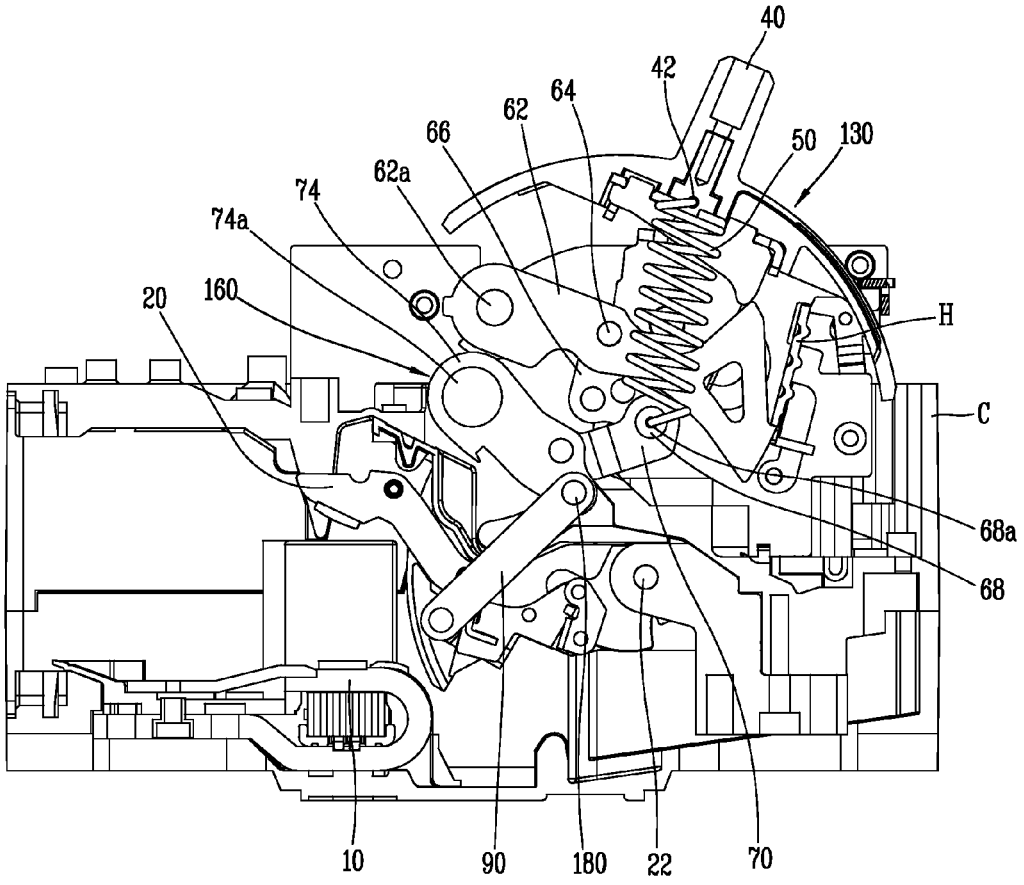
FIG. 2 is a cross-sectional view illustrating a circuit breaker according to the present disclosure.
Figure 3:
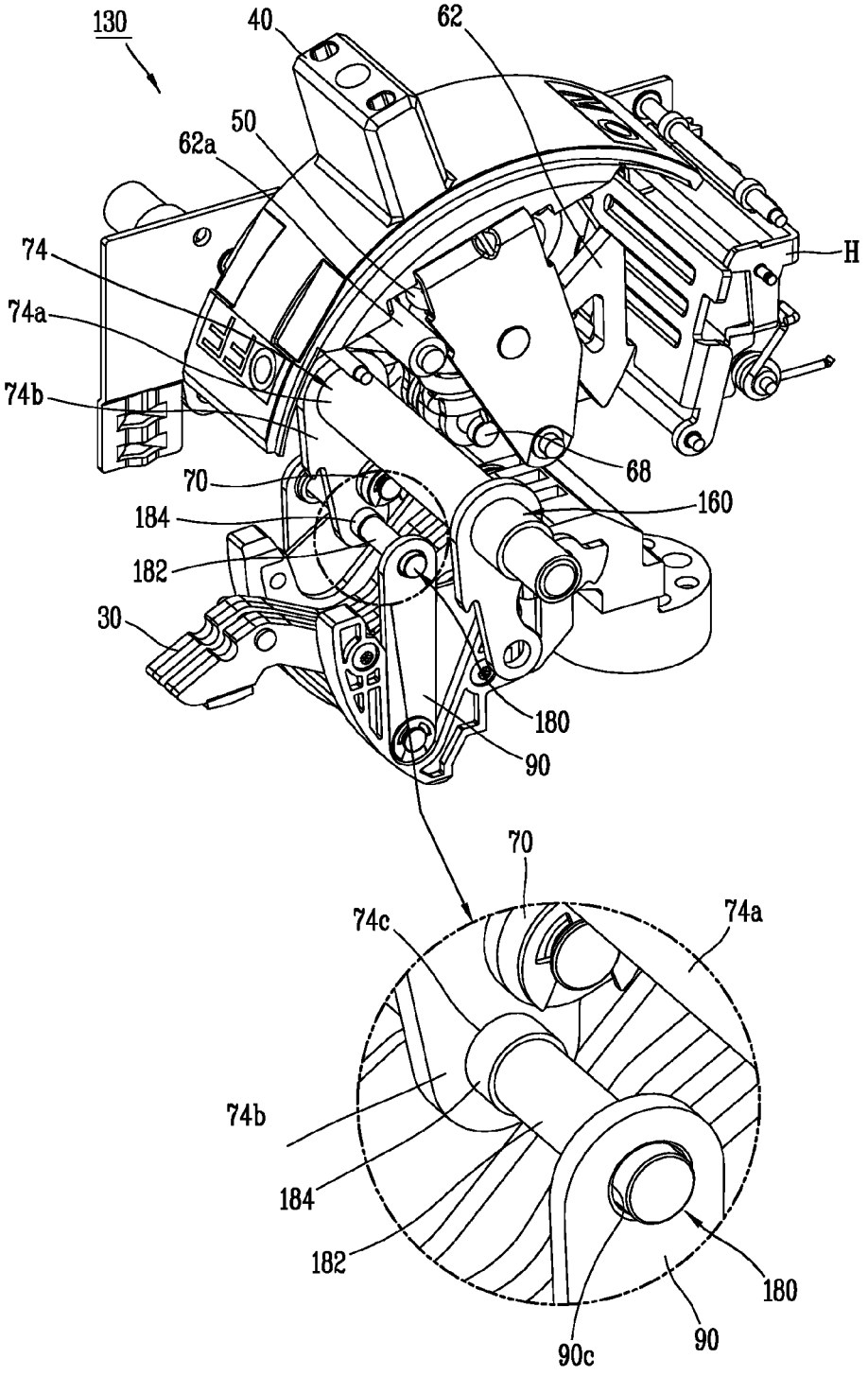
FIG. 3 is a perspective view illustrating a switching mechanism in FIG. 2.

FIG. 2 is a cross-sectional view illustrating a circuit breaker according to the present disclosure, and FIG. 3 is a perspective view illustrating a switching mechanism in FIG. 2.

As illustrated in FIGS. 2 and 3, a circuit breaker according to the present disclosure may include a stationary contact 10 installed in a fixed manner within a case (C); a movable contact 20 configured to be brought into contact with or separated from the stationary contact 10; and a switching mechanism 130 configured to rotate the movable contact 20 so as to switch a circuit.

The stationary contact 10 and the movable contact 20 may be brought into contact with each other to form a conduction path so as to receive power from the side of a power source and transfer it to the side of a load, and separated from each other to break the circuit.

The stationary contact 10 may be installed in a fixed manner within the case (C), and connected to the side of a power source or load.

The movable contact 20 may be hinge-coupled to the case (C) at one side thereof, and hinge-coupled to a transfer link 90 which will be described later at the other side thereof, and connected to the side of a load or power source. Here, a portion hinge-coupled to the case (C) is a movable contact rotation shaft 22.

The switching mechanism 30 may include a handle 40 provided for a user to perform a switching operation, a tension spring 50 for generating a driving force to allow the movable contact 20 to be brought into contact with or separated from the stationary contact 10, and a link apparatus 160 for transferring a driving force to the movable contact 20.

An end of the handle 40 may be hinge-coupled to an inner portion of the case (C), and the other end thereof may be protruded from the case (C).

Furthermore, a first spring fastening portion 42 may be provided at one side of the handle 40 separated from a handle rotation shaft (not shown).

In this case, when the circuit breaker is switched from a closing operation (ON) to an opening operation (OFF or TRIP), the first spring fastening portion 42 may move around an axis formed between a rocker rotation axis 64 and a second spring fastening portion 68*a* which will be described later from one side in a direction opposite to the one side.

The tension spring 50 may be supported by the first spring fastening portion 42 at one end thereof, and supported by the second spring fastening portion 68*a* which will be described later at the other end thereof.

The link apparatus 160 may include a latch 62 for performing a trip operation, a rocker 66 for performing the role of a driving member joint with respect to the entire link apparatus 160, and a connecting link 70 for connecting the rocker 66 to a shaft 74 which will be described later, a shaft 74 for performing the role of a driving member joint with respect to the movable contact 20 while at the same time performing the role of a follower member joint with respect to the rocker 66, and a transfer link 90 for connecting the shaft 74 to the movable contact 20.

The latch 62 may be hinge-coupled to an inner portion of the case (C) at one side thereof, and installed to be engaged with a separate latch holder (H) at the other side thereof.

In this case, the latch 62 may be engaged with the latch holder (H) to perform the role of a fixed supporting position for operating the other constituent elements of the link apparatus 160 when the circuit breaker is in a closing operation (ON) or artificial opening operation (OFF).

Furthermore, the latch 62 may be released from the latch holder (H) to be rotated when the circuit breaker is in an opening operation (TRIP) due to an accident. Due to this, the latch 62 may perform the role of a link member connected to the other constituent elements of the link apparatus 160.

The rocker 66 may be rotatably installed in the latch 62 at one side thereof, and hinge-coupled to the connecting link 70 at the other side thereof.

In this case, a second spring fastening portion 68*a* for supporting the other end of the tension spring 50 may be provided in a pin 68 for hinge-coupling the rocker 66 to the connecting link 70. Due to this, a driving force due to the tension spring 50 is applied to the pin 68, and the rocker 66 may perform the role of a driving member joint with respect to the entire link apparatus 160. However, the second spring fastening portion 68*a* may be formed on another constituent element such as the rocker 66, or the like.

The shaft 74 may be rotatably installed in the case (C) at one side thereof, and hinge-coupled to the connecting link 70 at the other side thereof.

Furthermore, the shaft 74 may be hinge-coupled to the transfer link 90 by an insulating pin 180 which will be described later at separated portions of the one side and the other side thereof.

In this case, the shaft 74 may transfer a driving force received from the rocker 66 through the connecting link 70 to the movable contact 20 through the transfer link 90. In other words, the shaft 74 may perform the role of a driving member joint with respect to the movable contact 20 while at the same time performing the role of a follower member joint with respect to the rocker 66.

The connecting link 70 may be hinge-coupled to the other side of the rocker 66 at one side thereof, and hinge-coupled to the other side of the shaft 74 at the other side thereof as described above.

The transfer link 90 may be hinge-coupled to at separated portions of the one side and the other side of the shaft 74 by an insulating pin 180 which will be described later at one side thereof as described above, and hinge-coupled to the other side of the movable contact 20 at the other side thereof.

The insulating pin 180 may hinge-couple the shaft 74 to the transfer link 90 as well as insulate the shaft 74 and the transfer link 90 from each other.

Here, for the sake of convenience of explanation, portions hinge-coupled thereto by the insulating pin 180 may be referred to as a shaft connecting port 74*c* and a transfer link connecting port 90*c*. In other words, separated portions of the one side and the other side thereof may be referred to as the shaft connecting port 74*c*, and one side of the transfer link 90 may be referred to as the transfer link connecting port 90*c*.

Figure 4:
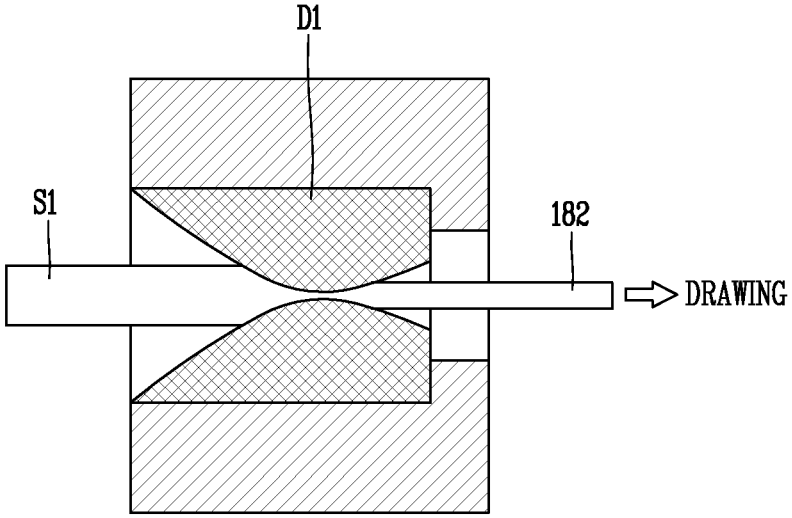
FIG. 4 is a cross-sectional view illustrating the process of forming an insulating member in FIG. 3.
Figure 5:
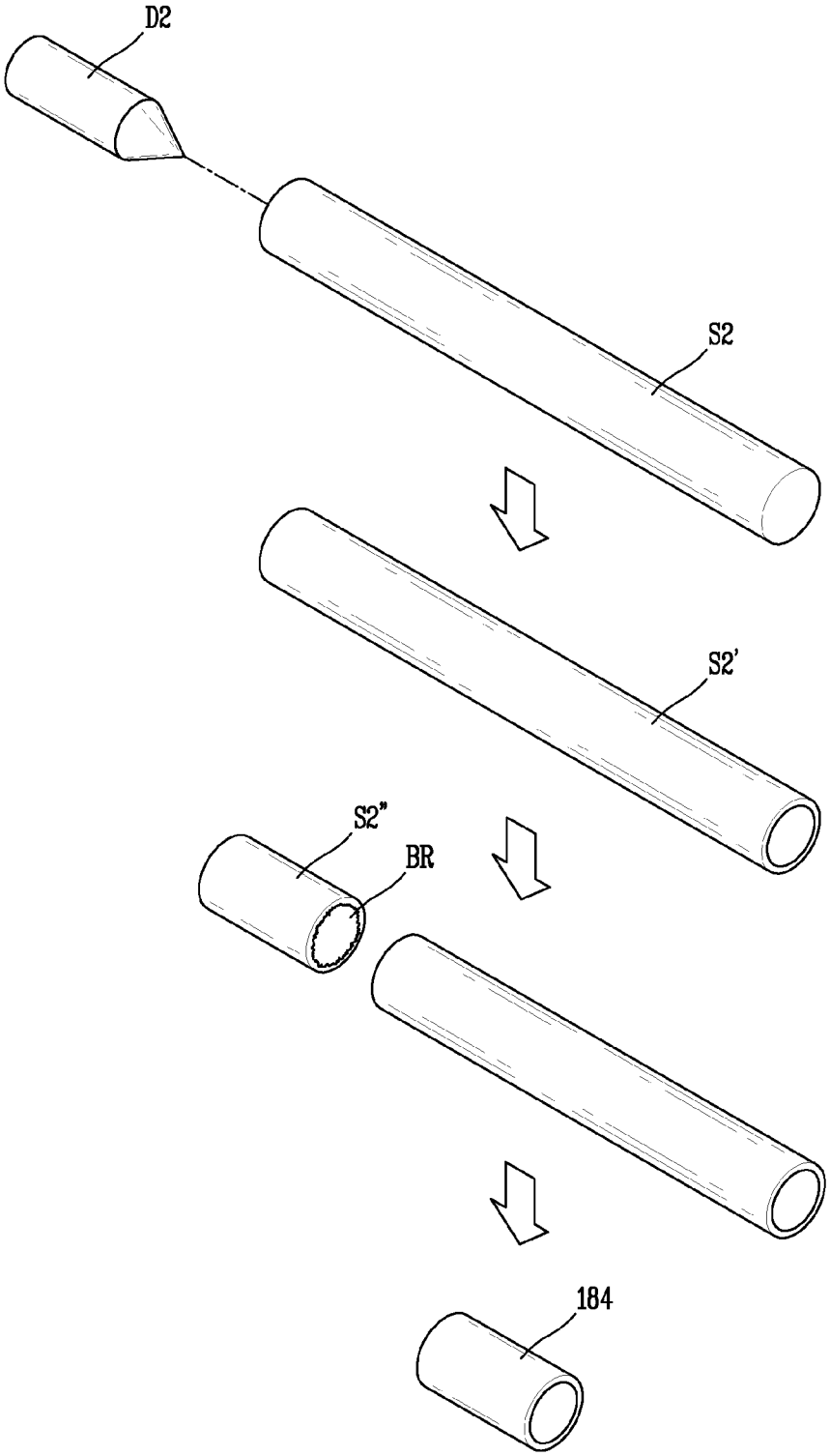
FIG. 5 is a perspective view illustrating the process of forming a wear resistant member in FIG. 3.
Figure 6:
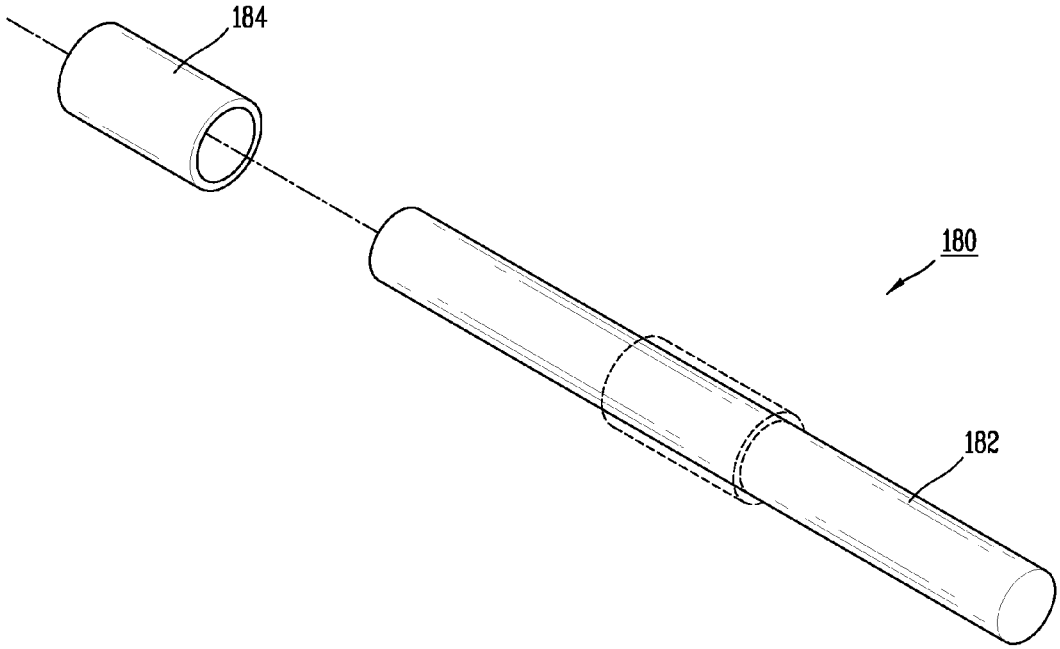
FIG. 6 is an assembly view illustrating an insulating member and a wear resistant member in FIGS. 4 and 5.
Figure 7:
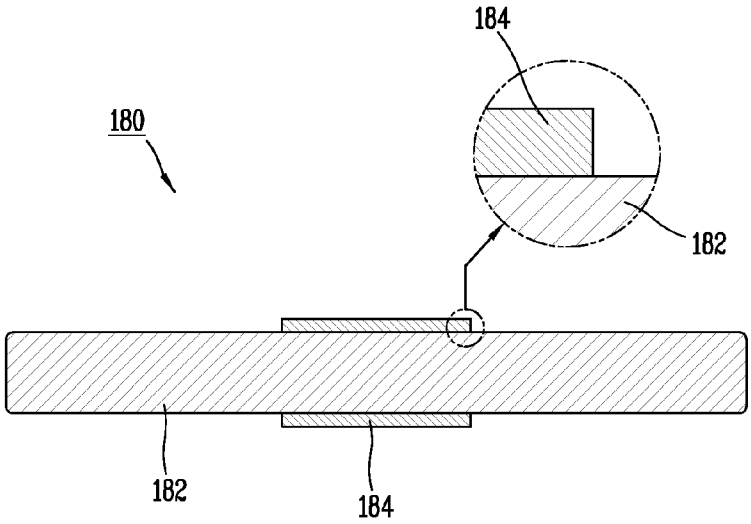
FIG. 7 is a cross-sectional view subsequent to the assembly of FIG. 6.
Figure 8A:
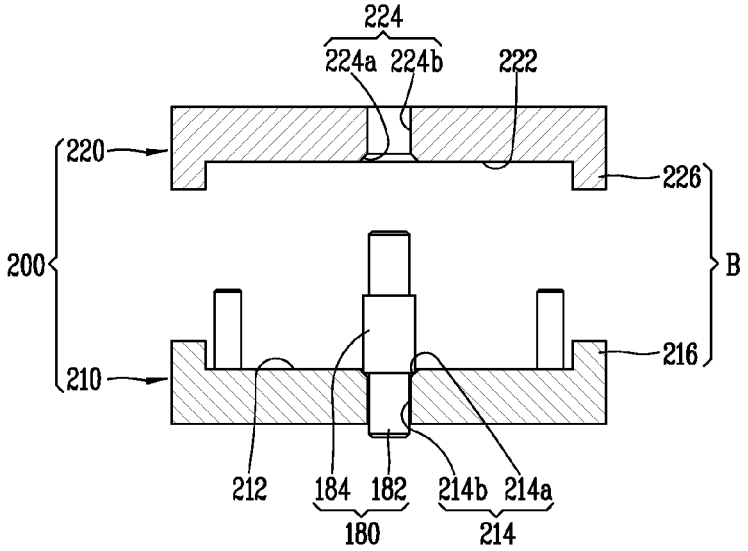
FIG. 8A, FIG. 8B and FIG. 8C are cross-sectional views illustrating the process of pressing an insulating pin with a press.
Figure 8B:
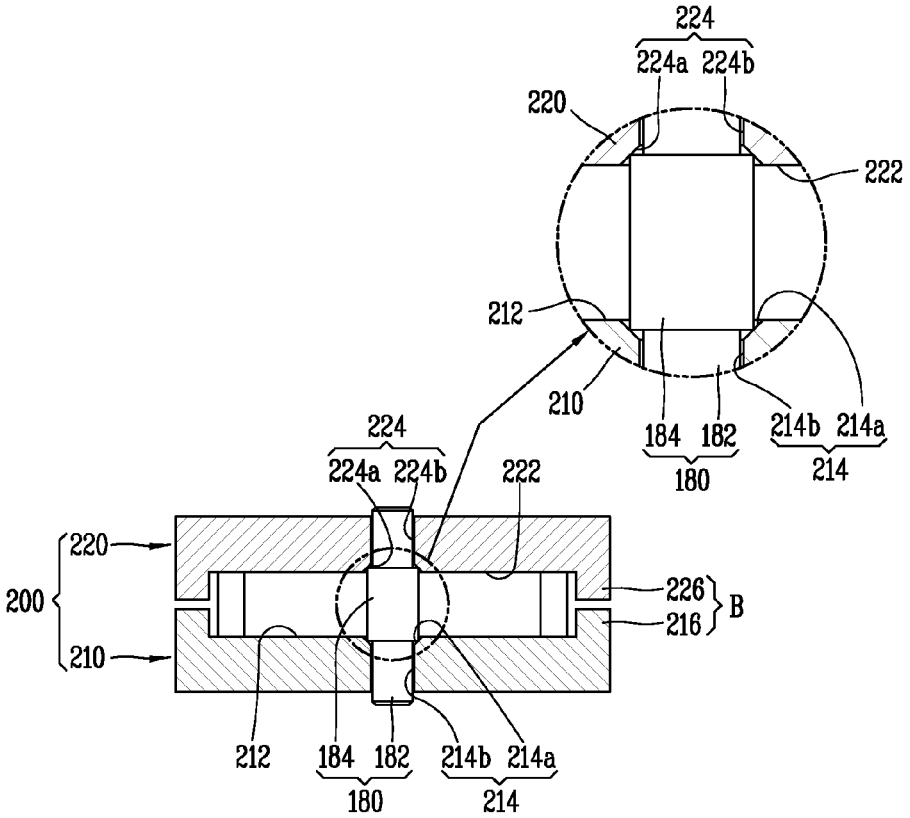
Figure 8C:
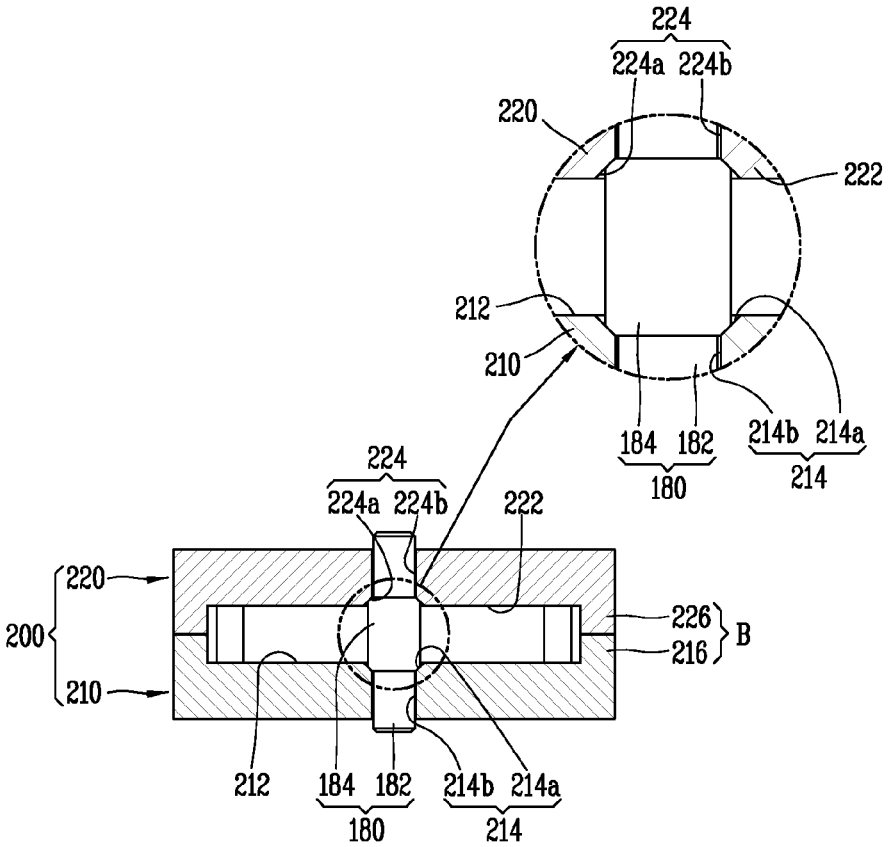
Figure 9:
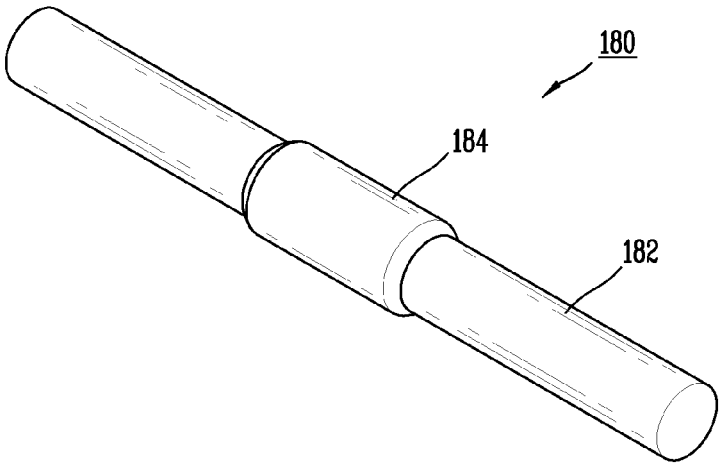
FIG. 9 is a cross-sectional view illustrating the insulating pin of FIG. 3 fabricated by the pressure process of FIG. 8A, FIG. 8B and FIG. 8C.
Figure 10:
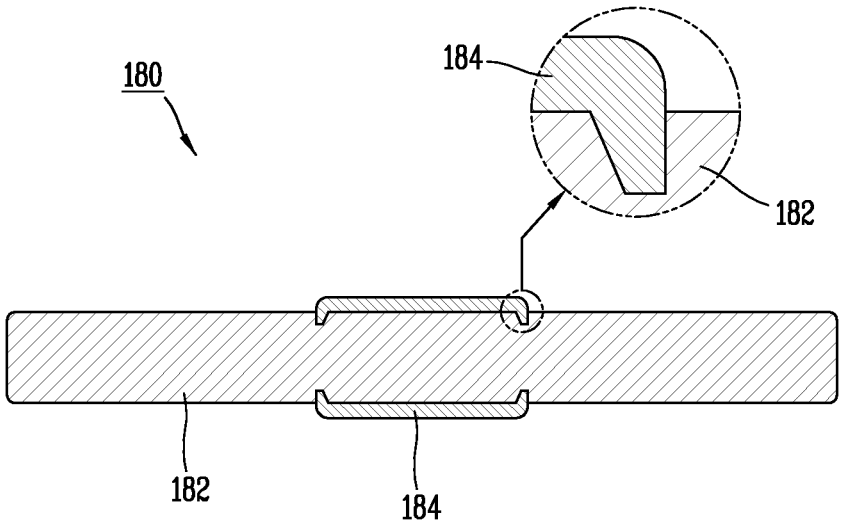
FIG. 10 is a cross-sectional view in FIG. 9.
Figure 11:
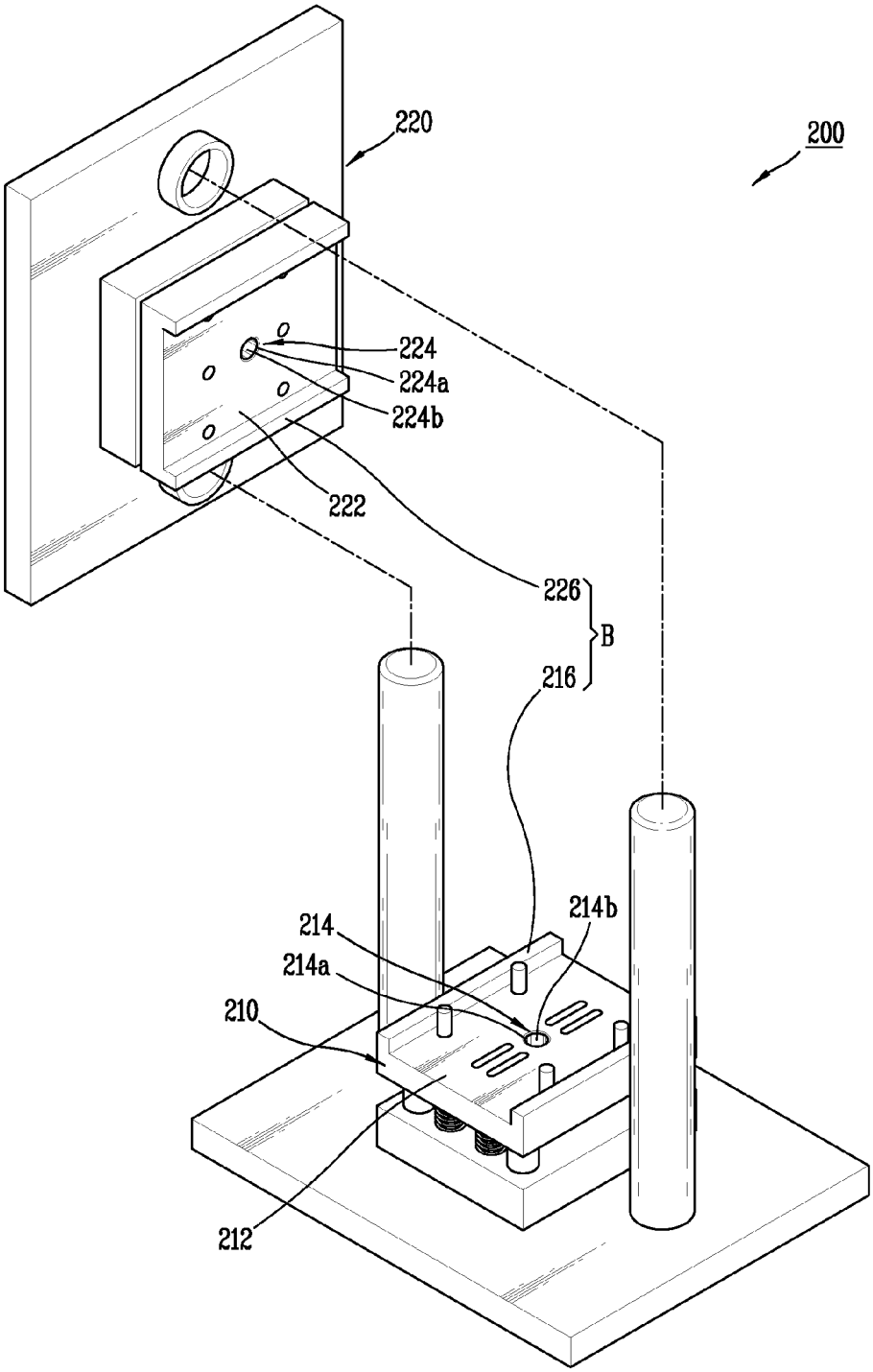
FIG. 11 is a perspective view illustrating a press in FIG. 8A, FIG. 8B and FIG. 8C.

FIG. 4 is a cross-sectional view illustrating the process of forming an insulating member in FIG. 3, and FIG. 5 is a perspective view illustrating the process of forming a wear resistant member in FIG. 3, and FIG. 6 is an assembly view illustrating an insulating member and a wear resistant member in FIGS. 4 and 5, and FIG. 7 is a cross-sectional view subsequent to the assembly of FIG. 6, and FIG. 8A, FIG. 8B and FIG. 8C are cross-sectional views illustrating the process of pressing an insulating pin with a press, and FIG. 9 is a cross-sectional view illustrating the insulating pin of FIG. 3 fabricated by the pressure process of FIG. 8A, FIG. 8B and FIG. 8C, and FIG. 10 is a cross-sectional view in FIG. 9, and FIG. 11 is a perspective view illustrating a press in FIG. 8A, FIG. 8B and FIG. 8C.

As illustrated in FIGS. 3 and 9, the insulating pin 180 may include a wear resistant member 184 installed to surround a contact portion between an insulating member 182 formed in a cylindrical rod shape and the shaft connecting port 74*c* of the insulating member 182.

In this case, the insulating member 182 may be formed of polyethylene, but may be also formed of other materials having an insulating performance.

Furthermore, the wear resistant member 184 may be formed of stainless steel, but may be also formed of other materials having a wear resistance larger than that of the insulating member 182.

The insulating pin 180 may be fabricated as follows.

First, the insulating member 182 may be formed in a cylindrical rod shape as described above.

The insulating member 182 may be formed using a drawing process for allowing a raw material (S1) to pass through a drawing die (D1) and then cutting the raw material (S1) as illustrated in FIG. 4.

On the other hand, the wear resistant member 184 may be formed in a cylinder shape having a length shorter than that of the insulating member 182, and a length greater than that of a contact portion to the shaft connecting port 74*c* of the insulating member 182 to surround the circumference of a contact portion to the shaft connecting port 74*c* of the insulating member 182.

The wear resistant member 184 may be formed perpendicular to an outer circumferential surface and an inner circumferential surface of the wear resistant member 184 as illustrated in FIGS. 5 through 7 prior to pressing the cross section of both end portions at an initial stage.

It is not to interfere with the insulating member 182 as illustrated in FIG. 7 prior to pressing the wear resistant member 184, and to perform plastic deformation on the end portion in the form of having an excellent release resistance strength as illustrated in FIG. 10 subsequent to pressing the wear resistant member 184.

For reference, when inclined inner chamfers are formed on the cross section of the end portion and the inner circumferential surface, respectively, contrary to the foregoing description, the wear resistant member 184 may have a release resistance strength subsequent to pressure process lower than when the cross section of the end portion is formed perpendicular to the inner circumferential surface.

Subsequently, in order to form the cross section of both end portions perpendicular to an outer circumferential surface and an inner circumferential surface of the wear resistant member 184, the wear resistant member 184 may be formed such that a cylindrically shaped material (S2) is drilled in a length direction by a drill (D2), and the drilled material (S2') is cut by a predetermined length, and a burr (BR) of the cut material (S") is removed as illustrated in FIG. 5.

For reference, when the cylindrically shaped material (S2) is cut by a predetermined length and then the cut material is drilled in an axial direction, the wear resistant member 184 may be subject to a dimensional deformation problem.

Accordingly, the wear resistant member 184 may be preferably formed that the cylindrically shaped material (S2) is drilled in a length direction, and the drilled material (S2') is cut by a predetermined length, and a burr (BR) of the cut material (S") is removed as described above.

Here, the predetermined length is a length shorter than that of the insulating member 182, and greater than that of a contact portion to the shaft connecting port 74*c* of the insulating member 182 to surround the circumference of a contact portion to the shaft connecting port 74*c* of the insulating member 182.

Subsequently, the insulating member 182 and the wear resistant member 184 formed as described above may be formed in such a manner that the insulating member 182 is inserted into an inner side of the wear resistant member 184 as illustrated in FIGS. 6 and 7.

Due to this, it may be disposed such that the wear resistant member 184 is attached to a contact portion to the shaft connecting port 74*c* of the insulating member 182.

Next, at least one end of the wear resistant member 184 may be plastically deformed to burrow into an inner side, namely, toward a central portion thereof from an outer circumferential surface of the insulating member 182 by a pressure process such as a caulking process or the like.

In case of the present embodiment, the wear resistant member 184 may be plastically deformed to allow both end portions to burrow into an inner side from an outer circumferential surface of the insulating member 182 with a pressure process using the press 200 as illustrated in FIGS. 8 and 10.

More specifically, both end portions of the wear resistant member 184 disposed at a contact portion to the shaft connecting port 74*c* of the insulating member 182 as illustrated in FIG. 7 may be pressed against the press 200 as illustrated in FIG. 8A, FIG. 8B and FIG. 8C.

Here, the press 200 may press both ends of the wear resistant member 184 in an axial direction of the wear resistant member 184 by a predetermined dimension.

The press 200 may include a die 210 installed in a fixed manner, and a punch 220 installed to face the die 210 so as to move toward the die 210 as illustrated in FIGS. 8 and 11.

The die 210 may include a first press surface 212 which is a plane facing in parallel to a second press surface 222 of the punch 220 which will be described later and a first groove 214 formed perpendicular to the first press surface 212.

The first groove 214 may include a first insertion portion 214*b* formed in an engraved cylindrical shape in a direction perpendicular to the first press surface 212.

Furthermore, the first groove 214 may include a first chamfer portion 214*a* inclined to an inner circumferential surface of the first insertion portion 214*b* and the first press surface 212, respectively.

According to the foregoing configuration, the insulating pin 180 (hereinafter, referred to as an "insulating pin prior to plastic deformation") in a state that the wear resistant member 184 is disposed at a contact portion to the shaft connecting port 74*c* of the insulating member 182 may be formed such that an end of the wear resistant member 184 is engaged with the first chamfer portion 214*a*, and an end of the insulating member 182 protruded from an end of the wear resistant member 184 is inserted into the first insertion portion 214*b*.

Due to this, the insulating pin 180 prior to plastic deformation may be placed perpendicular to the first press surface 212 with respect to the length direction.

The punch 220 may include a second press surface 222 which is a plane facing in parallel to the first press surface 212 and a second groove 224 formed perpendicular to the second press surface 222 to correspond to the first groove 214.

The second groove 224 may include a second insertion portion 224*b* formed in an engraved cylindrical shape in a direction perpendicular to the second press surface 222.

Furthermore, the second groove 224 may include a second chamfer portion 224*a* inclined to an inner circumferential surface of the second insertion portion 224*b* and the second press surface 222 and, respectively.

Due to the foregoing configuration, when the punch moves toward the die, the insulating pin 180 prior to plastic deformation placed on the die may be formed such that the other end of the wear resistant member 184 is engaged with the second chamfer portion 224*a*, and the other end of the insulating member 182 protruded from the other end of the wear resistant member 184 is inserted into the second insertion portion 224*b*.

Here, the first chamfer portion 214*a* is formed to be inclined to an inner circumferential surface of the first insertion portion 214*b* and the second chamfer portion 224*a* is formed to be inclined to an inner circumferential surface of the second insertion portion 224*b*.

Due to this, the first chamfer portion 214*a* and the second chamfer portion 224*a* deform both ends of the wear resistant member 184 while moving along an inclined surface to burrow into the insulating member 182 when both ends of the wear resistant member 184 is pressed.

On the other hand, the die 210 and the punch 220 may include an excessive compression prevention protrusion (B) configured not to allow the first press surface 212 and the second press surface 222 to get closer more than a predetermined distance when pressing both ends of the wear resistant member 184.

The excessive compression prevention protrusion (B) may include a first excessive compression prevention protrusion 216 protruded toward the second press surface from the first press surface 212 and a second excessive compression prevention protrusion 226 protruded to face the first excessive compression prevention protrusion 216 from the second press surface 222.

The sum of a protrusion length from the first press surface 212 of the first excessive compression prevention protrusion 216 and a protrusion length from the second press surface 222 of the second excessive compression prevention protrusion 226 may be formed to be the same as the predetermined distance.

Here, the predetermined dimension and the predetermined distance may be a value for preventing a bending phenomenon from occurring on an outer circumferential surface of the wear resistant member 184. The bending phenomenon refers to a phenomenon a rugged bend are generated on an outer circumferential surface of the wear resistant member 184 when both ends of the wear resistant member 184 is excessively pressed.

Subsequently, both ends of the wear resistant member 184 pressed by the press 200 provided as described above may be plastically deformed to burrow into an inner side from an outer circumferential surface of the insulating member 182 as illustrated in FIG. 10.

Due to this, the wear resistant member 184 may be installed in a fixed manner at a contact portion to the shaft connecting port 74*c* of the insulating member 182 not to be released in a length direction of the insulating member 182, namely, in an axial direction of the insulating member 182.

Up to now, a method of fabricating the insulating pin 180 according to an embodiment has been described.

However, the present disclosure may not be necessarily limited to this, and there may be various modified examples for a method of fabricating the insulating pin 180.

In other words, the insulating member 182 are formed with a drawing process according to the present embodiment, but may be also formed with a cutting process or the like.

Furthermore, the cross section of an end portion of the wear resistant member 184 prior to performing a pressure process may be formed perpendicular to an outer circumferential surface and an inner circumferential surface of the wear resistant member 184 according to the present embodiment, but may be also formed with other shapes if it is able to achieve the foregoing objective (when an end portion of the wear resistant member is formed with a pressure process, it is plastically deformed in the form having an excellent release resistance strength).

Furthermore, an end portion of the wear resistant member 184 may be deformed and fixed to the insulating member 182 according to the present embodiment, but may be also fixed thereto using an adhesive or the like.

Figure 12:
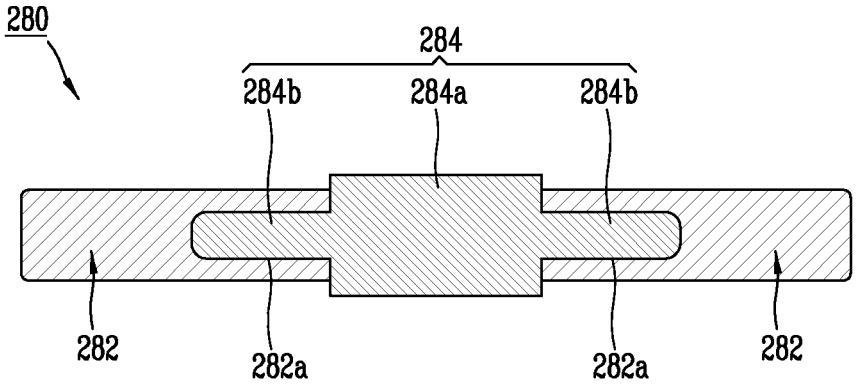
FIG. 12 is a cross-sectional view illustrating another embodiment of an insulating pin in FIG. 3.

Furthermore, the insulating pin 180 may be formed with a method as illustrated in FIG. 12.

FIG. 12 is a cross-sectional view illustrating another embodiment of an insulating pin in FIG. 3.

As illustrated in FIG. 12, the insulating pin 280 formed with a different method may include a wear resistant member 284 having a protruding portion and an insulating member 282 overlaid on the protruding portion.

The wear resistant member 284 having the protruding portion may include a shaft connecting port contact portion 284*a* formed in a cylindrical shape and a protruding portion 284*b* extended and formed in a length direction of the shaft connecting port contact portion 284*a* from at least one end portion of the shaft connecting port contact portion 284*a*.

In this case, the protruding portion 284*b* may be extended and formed in a length direction of the shaft connecting port contact portion 284*a* from the center of an end portion of the shaft connecting port contact portion 284*a*.

The protruding portion 284*b* may have a diameter smaller than that of the shaft connecting port contact portion 284*a*.

The insulating member 282 overlaid on the protruding portion may be formed in a cylindrical shape having a diameter smaller than that of the shaft connecting port contact portion 284*a* and a diameter greater than that of the protruding portion 284*b*.

Furthermore, a groove portion 282*a* into which the protruding portion 284*b* is inserted may be formed at the center of an end portion of the insulating member 282 overlaid on the protruding portion.

The wear resistant member 284 having the protruding portion and the insulating member 282 overlaid on the protruding portion may be fastened in such a manner that the protruding portion 284*b* is inserted into the groove portion 282*a*.

In this case, the wear resistant member 284 having the protruding portion and the insulating member 282 overlaid on the protruding portion may be fastened by a frictional force due to a surface contact between the protruding portion 284*b* and the groove portion 282*a*.

However, the wear resistant member 284 having the protruding portion and the insulating member 282 overlaid on the protruding portion may be fastened with a different method.

For example, when at least one or more release preventing protrusions (not shown) are formed in a circumferential direction on an outer circumferential surface of the protruding portion 284*b*, and at least one or more release preventing grooves (not shown) are formed in a circumferential direction on an inner circumferential surface of the groove portion 282*a* to insert the protruding portion 284*b* into the groove portion 282*a*, the release preventing protrusion may be caught in the release preventing groove. Due to this, the wear resistant member 284 having the protruding portion and the insulating member 282 overlaid on the protruding portion are fastened with each other.

On the other hand, according to the present embodiment, the press 200 may be formed in such a manner that the first excessive compression prevention protrusion 216 is protruded from the first press surface 212 and the second excessive compression prevention protrusion 226 is protruded from the second press surface 222. Furthermore, the first excessive compression prevention protrusion 216 and the second excessive compression prevention protrusion 226 may be brought into contact with each other during a pressure process not to allow the first press surface 212 and the second press surface 222 to get closer more than a predetermined distance.

However, the present disclosure may not be necessarily limited to this.

For an example, only the first excessive compression prevention protrusion 216 may be formed on the press 200.

In this case, the second press surface 222 may be extended and formed in a flat manner up to a portion corresponding to the first excessive compression prevention protrusion 216.

Furthermore, the first excessive compression prevention protrusion 216 may be formed in such a manner that a protrusion length from the first press surface 212 is the same as the predetermined distance.

According to the foregoing configuration, when the die 210 and the punch 220 press both ends of the wear resistant member 284, the first excessive compression prevention protrusion 216 may be brought into contact with second press surface 222, thereby suppressing the first and the second press surface from getting closer more than a predetermined distance.

For another example, the excessive compression prevention protrusion (B) can be omitted as a whole.

In this case, the moving distance of the punch 220 may be controlled not to allow the first press surface 212 and the second press surface 222 to get closer than a predetermined distance.

For still another example, the first excessive compression prevention protrusion 216 and the second excessive compression prevention protrusion 226 may be formed to be protruded from another portion such as a lateral surface of the die 210, a lateral surface of the 220, or the like. In other words, the first excessive compression prevention protrusion 216 and the second excessive compression prevention protrusion 226 may be formed to be protruded from a portion other than the first press surface 212 and the second press surface 222.

On the other hand, according to the present embodiment, a pair of the first excessive compression prevention protrusions 216 may be formed to be located at opposite sides to each other by interposing the first groove 214 therebetween, and a pair of the second excessive compression prevention protrusions 226 may be formed to be located at opposite sides to each other by interposing the second groove 224 therebetween to correspond to the pair of the first excessive compression prevention protrusions 216.

It is to maintain the first press surface 212 and the second press surface 222 in parallel to each other when the first excessive compression prevention protrusion 216 and the second excessive compression prevention protrusion 226 are brought into contact with each other.

However, if the first press surface 212 and the second press surface 222 maintain a parallel relation to each other, then the first excessive compression prevention protrusion 216 and the second excessive compression prevention protrusion 226 may be formed in a different shape.

For example, when a contact surface between the first excessive compression prevention protrusion 216 and the second excessive compression prevention protrusion 226 has a sufficiently large area, only each one of them may be formed thereon.

Next, subsequent to a method of fabricating the insulating pin 180, the additional description of a constituent element of the circuit breaker according to the present disclosure will be described.

In other words, referring to FIG. 3, a circuit breaker according to the present disclosure may be formed with a plurality of phases, and a pair of the stationary contact 10 and the movable contact 20 may be provided for each phase.

Accordingly, the switching mechanism 130 should be formed with a structure capable of switching a plurality of the movable contacts 20.

Consequently, for the switching mechanism 130, the transfer link 90 and the insulating pin 180 may be provided for each phase, and the other constituent elements of the switching mechanism 130 may be provided one by one.

Here, the shaft arm 74*b* protruded in a radial direction from the shaft rotation axis 74*a* may be formed for the shaft 74 for each phase.

The shaft arm 74*b* is hinge-coupled to the transfer link 90 by the insulating pin 180.

On the other hand, on the basis of one phase, the latch 62, the rocker 66, the connecting link 70 and the shaft 74 may constitute a 5-joint link mechanism when the circuit breaker performs an opening operation (TRIP) due to an accident.

In the 5-joint link mechanism configured with the latch 62, the rocker 66, the connecting link 70 and the shaft 74, a link for virtually connecting the latch rotation axis 62*a* to the shaft rotation axis 74*a* constitutes a stationary joint, and the latch 62, the rocker 66, the connecting link 70 and the shaft 74 are able to move.

Furthermore, the latch 62, the rocker 66, the connecting link 70 and the shaft 74 may constitute a 4-joint link mechanism when the circuit breaker performs a closing operation (ON) or artificial opening operation (TRIP).

In the 4-joint link mechanism configured with the latch 62, the rocker 66, the connecting link 70 and the shaft 74, the latch 62 may be fixed by the latch holder (H).

Consequently, in the 4-joint link mechanism configured with the latch 62, the rocker 66, the connecting link 70 and the shaft 74, a link for virtually connecting the rocker rotation axis 64 to the shaft rotation axis 74*a* constitutes a stationary joint, and the rocker 66, the connecting link 70 and the shaft 74 are able to move.

Hereinafter, for the sake of convenience of explanation, in the 4-joint link mechanism configured with the latch 62, the rocker 66, the connecting link 70 and the shaft 74 is referred to as the 4-joint link mechanism configured with the rocker 66, the connecting link 70 and the shaft 74.

Furthermore, the shaft 74, the transfer link 90 and the movable contact 20 may constitute a 4-joint link mechanism.

In the 4-joint link mechanism configured with the shaft 74, the transfer link 90 and the movable contact 20, a link for virtually connecting the shaft 74 to the movable contact 20 constitutes a stationary joint, and the shaft 74, the transfer link 90 and the movable contact 20 are able to move.

Here, the 4-joint link mechanism configured with the shaft 74, the transfer link 90 and the movable contact 20 may share the shaft 74 with a 5-joint link mechanism configured with the latch 62, the rocker 66, the connecting link 70 and the shaft 74 (or a 4-joint link mechanism configured with the rocker 66, the connecting link 70 and the shaft 74.

Due to this, the 4-joint link mechanism configured with the shaft 74, the transfer link 90 and the movable contact 20 may be a link mechanism driven by the 5-joint link mechanism configured with the latch 62, the rocker 66, the connecting link 70 and the shaft 74 (or 4-joint link mechanism configured with the rocker 66, the connecting link 70 and the shaft 74).

On the drawing, it should be noted that the same reference numerals are designated to the same portions in the related art.

The working effect of a circuit breaker and a method of fabricating an insulating pin for a switching mechanism thereof according to the present disclosure will be described.

First, the process of switching a circuit breaker from an artificial opening operation (OFF) state to a closing operation (ON) state will be described.

In an artificial opening operation (OFF) state illustrated in FIG. 2, when the operator rotates the handle 40 in a counter clockwise direction on the drawing, the tension spring 50 can be rotated in a counter clockwise direction on the drawing around the second spring fastening portion 68*a*.

Accordingly, a spring force may be applied to the second spring fastening portion 68*a* in a left upward direction on the drawing.

The spring force may rotate the rocker 66 in a clockwise direction on the drawing, and rotate the shaft 74 in a clockwise direction on the drawing, and as a result, it may be operated as a driving force for rotating the movable contact 20 in a counter clockwise direction on the drawing.

As a result, referring to FIG. 2, in the 4-joint link mechanism configured with the rocker 66, the connecting link 70 and the shaft 74, the rocker 66 may be rotated in a clockwise direction on the drawing.

Accordingly, the connecting link 70 may be engaged with the pin 68 provided with the second spring fastening portion 68*a*, and moved while being rotated in a counter clockwise direction on the drawing.

Accordingly, the shaft 74 may be rotated in a clockwise direction on the drawing.

Accordingly, in the 4-joint link mechanism configured with the shaft 74, the transfer link 90 and the movable contact 20, the transfer link 90 may be engaged with the insulating pin 180, and moved while being rotated in a counter clockwise direction on the drawing.

Accordingly, the movable contact 20 may be rotated in a counter clockwise direction on the drawing to be brought into contact with the stationary contact 10.

As a result, the circuit breaker may be in a closing operation (ON) state.

On the other hand, the process of switching a circuit breaker from a closing operation (ON) state to an artificial opening operation (OFF) state is opposite to the process of switching a circuit breaker from an artificial opening operation (OFF) state to a closing operation (ON) state as described above, and the detailed description thereof will be omitted.

Next, the process of switching a circuit breaker from a closing operation (ON) state to an opening operation (TRIP) state due to an accident will be described.

Prior to the description, the closing operation (ON) state will be described with reference to FIG. 2 though not illustrated additionally.

When an abnormal current occurs in the closing operation (ON) state, the latch holder (H) may be rotated in a clockwise direction to release the locking of the latch 62.

Accordingly, the latch 62 may be rotated around the latch rotation axis 62*a*.

Accordingly, the spring force that has been applied to the second spring fastening portion 68*a* in a left upward direction may rotate the latch 62 in a counter clockwise direction, and rotate the shaft 74 in a counter clockwise direction, and thus operated as a driving force for rotating the movable contact 20 in a clockwise direction.

As a result, in the 5-joint link mechanism configured with the latch 62, the rocker 66, the connecting link 70 and the shaft 74, the latch 62 may be rotated in a counter clockwise direction.

Accordingly, the rocker 66 is restricted by the rocker rotation axis 64, and thus moved while being rotated in a counter clockwise direction.

Accordingly, the connecting link 70 is restricted by the pin 68 provided with the second spring fastening portion 68*a*, and thus moved while being rotated in a counter clockwise direction.

Accordingly, the shaft 74 may be rotated in a counter clockwise direction.

Accordingly, in the 4-joint link mechanism configured with the shaft 74, the transfer link 90 and the movable contact 20, the transfer link 90 may be restricted by the insulating pin 180, and thus moved while being rotated in a clockwise direction.

Accordingly, the movable contact 20 may be rotated in a counter clockwise direction, and thus separated from the stationary contact 10.

As a result, the circuit breaker may be in an opening operation (TRIP) state due to an accident.

In this case, the opening operation (TRIP) state, when compared to FIG. 2, may be in a state that the handle 40 may be rotated in a counter clockwise direction, and the latch 62 is released from the locking of the latch holder (H) and rotated in a counter clockwise direction.

On the other hand, the process of rotating the handle 40 in a clockwise direction to engage the latch 62 with the latch holder (H) again so as to switch the circuit breaker to an artificial opening operation (OFF) state as illustrated in FIG. 2 precedes the process of switching the circuit breaker from a opening operation (TRIP) state due to an accident to an closing operation (ON) state. The following process is the same as the process of switching the circuit breaker from the artificial opening operation (OFF) state to the closing operation (ON) state, and the description thereof will be omitted to avoid redundant description.

During the process, the insulating pin 180 may hinge-couple and insulate the shaft 74 and the transfer link 90.

In other words, the insulating pin 180 may be hinge-coupled to the shaft connection opening 74*c* at the wear resistant member 184, and hinge-coupled to the transfer link connection opening 90*c* at both ends of the insulating member 182 as illustrated in FIG. 3.

Due to this, the insulating pin 180 may transfer a driving force to the transfer link 90 from the shaft 74.

Furthermore, the insulating pin 180 may be insulated by the insulating member 182, thereby preventing a current applied to the transfer link 90 from the movable contact 20 from flowing to the shaft 74.

In other words, the insulating pin 180 may perform phase-phase insulation to prevent dielectric breakdown from occurring from a particular phase to another phase through the shaft 74.

Furthermore, the wear resistant member 184 of the insulating pin 180 may be installed between the shaft connection opening 74*c* and a contact portion to the shaft 74 of the insulating member 182.

Due to this, the wear resistant member 184 may protect the insulating member 182 having a hardness lower than that of the shaft 74, thereby preventing the insulating member 182 from being worn by the shaft 74.

Here, a circuit breaker and a method of fabricating an insulating pin for a switching mechanism thereof according to the present disclosure may include the movable contact 20 configured to be brought into contact with or separated from the stationary contact 10 and the switching mechanism 130 configured to switch the movable contact 20.

The switching mechanism 130 may include the shaft 74 rotatably installed therein, the transfer link configured 90 to transfer a driving force from the shaft 74 to the movable contact 20, and the insulating pin 180 configured to hinge-couple the shaft to the transfer link and insulate them from each other.

The insulating pin 180 may include the insulating member 182 formed in a cylindrical shape, and the wear resistant member 184 formed with a pipe to be attached to a portion brought into contact with the shaft 74 of the insulating member 182.

At least one end of the wear resistant member 184 may be deformed to burrow into the insulating member, and thus installed to be fixed to the insulating member 182.

The wear resistant member 184 may be formed of a material such as stainless steel having a wear resistance greater than that of the insulating member 182 formed of an insulating material such as polyethylene.

The insulating pin 180 may be fabricated by a method of fabricating an insulating pin for a circuit breaker switching mechanism, and the method may include the first step of forming the insulating member 182 in a cylindrical shape, the second step of forming the wear resistant member 184 in a pipe shape capable of surrounding one side of the insulating member 182 which is a contact portion to the shaft 74, the third step of inserting the insulating member 182 into the wear resistant member 184 and disposing the wear resistant member 184 at one side of the insulating member 182, and the fourth step of deforming both ends of the wear resistant member 184 to burrow into the insulating member 182 so as to fix the wear resistant member 184 to one side of the insulating member 182.

Due to this, phase-to-phase insulation may be carried out, and the abrasion and damage of the insulating pin 180 due to the shaft 74 may be suppressed. As a result, it may be possible to solve a contact pressure reduction and contact resistance increase problem between the movable contact 20 and the stationary contact 10 due to the abrasion and damage of the insulating pin 180.

Furthermore, it may be possible to suppress the wear resistant member 184 from being released from an installation portion, more precisely, a portion brought into contact with the shaft 74 of the insulating member 182.

Furthermore, according to a circuit breaker and a method of fabricating an insulating pin for a switching mechanism thereof in accordance with the present disclosure, the cross section of both end portions of the wear resistant member 184 may be formed perpendicular to an inner circumferential surface thereof by drilling a cylindrically shaped material (S2) in a length direction, and cutting the drilled material (S2') by a predetermined length, and removing a burr (BR) of the cut material (S") during the second step.

Due to this, compared to a case where the cross section of both end portions of the wear resistant member 184 is not formed perpendicular to an inner circumferential surface thereof, an end portion of the wear resistant member 184 may be deformed to have an excellent release resistance strength during the fourth step.

Furthermore, according to a circuit breaker and a method of fabricating an insulating pin for a switching mechanism thereof in accordance with the present disclosure, both end portions of the wear resistant member 184 may be deformed to burrow into the insulating member 182 by the press 200 capable of pressing both end portion edges of the wear resistant member 184 in an axial direction of the wear resistant member 184 during the fourth step.

Due to this, the wear resistant member 184 may be easily fixed to the insulating member 182.

Furthermore, the press 200 may include the die 210 installed in a fixed manner; and the punch 220 configured to face the die 210, and installed to move toward the die 210.

At least one of the die 210 and the punch 220 may include an excessive compression prevention protrusion (B) protruded toward the other one thereof.

Due to this, when the die 210 and the punch 220 press both ends of the wear resistant member 184, the excessive compression prevention protrusion (B) may prevent the die 210 and the punch 220 from getting closer more than a predetermined distance, thereby suppressing the bending phenomenon from occurring on an outer circumferential surface of the wear resistant member 184.

What is claimed is:

1. A circuit breaker, comprising:

a stationary contact installed in a fixed manner;

a movable contact configured to be brought into contact with or separated from the stationary contact; and a switching mechanism configured to switch the movable contact, wherein the switching mechanism comprises:

a shaft rotatably installed therein;

a transfer link configured to transfer a driving force from the shaft to the movable contact; and a pin configured to hinge-couple the shaft to the transfer link and insulate them from each other, wherein the pin is installed with a wear resistant member at a portion brought into contact with a shaft arm of the shaft, wherein the pin comprises an insulating member formed in a cylindrical shape, wherein the wear resistant member is formed with a pipe and attached to the portion brought into contact with the shaft arm of the shaft, and wherein the wear resistant member is installed on the insulating member in a fixed manner not to be released therefrom.

2. The circuit breaker of claim 1, wherein:

the insulating member is inserted into the wear resistant member; and at least one end portion of the wear resistant member is deformed to burrow into the insulating member.

3. The circuit breaker of claim 1, wherein the wear resistant member is formed of a material having a wear resistance greater than a wear resistance of the insulating member.

4. The circuit breaker of claim 3, wherein:

the insulating member is formed of a polyethylene material; and the wear resistant member is formed of a stainless steel material.

* * * * *